US005794854A

United States Patent [19]

Yie

[11] Patent Number: 5,794,854

[45] Date of Patent: Aug. 18, 1998

[54] APPARATUS FOR GENERATING OSCILLATING FLUID JETS

[75] Inventor: Gene G. Yie, Auburn, Wash.

[73] Assignee: Jetec Company, Auburn, Wash.

[21] Appl. No.: 634,696

[22] Filed: Apr. 18, 1996

[51] Int. Cl.[6] ..... B05B 9/01

[52] U.S. Cl. ..... 239/242; 239/526; 239/586

[58] Field of Search ..... 239/237, 239, 239/240, 242, 246, DIG. 1; 2/526, 586; 137/157, 163

[56] References Cited

U.S. PATENT DOCUMENTS

| | | | |
|---|---|---|---|
| 2,485,504 | 10/1949 | Morgan . | |
| 3,063,646 | 11/1962 | Ballard | 239/242 |
| 3,650,470 | 3/1972 | Wertman | 239/242 X |
| 4,369,850 | 1/1983 | Barker . | |
| 4,449,332 | 5/1984 | Griffiths . | |
| 4,478,368 | 10/1984 | Yie . | |
| 4,534,427 | 8/1985 | Wang et al. . | |
| 4,662,565 | 5/1987 | Waldrum | 239/240 X |
| 4,666,083 | 5/1987 | Yie . | |
| 4,683,684 | 8/1987 | Yie . | |
| 4,690,325 | 9/1987 | Pacht . | |
| 4,765,540 | 8/1988 | Yie . | |
| 4,768,709 | 9/1988 | Yie . | |
| 5,078,320 | 1/1992 | Fuller et al. | 239/DIG. 1 X |
| 5,086,977 | 2/1992 | Kah, Jr. | 239/DIG. 1 X |
| 5,092,362 | 3/1992 | Yie . | |
| 5,117,872 | 6/1992 | Yie . | |
| 5,186,393 | 2/1993 | Yie . | |
| 5,297,777 | 3/1994 | Yie . | |
| 5,524,821 | 6/1996 | Yie et al. . | |

FOREIGN PATENT DOCUMENTS

| | | | |
|---|---|---|---|
| 2405621 | 6/1979 | France | 239/DIG. 1 |

*Primary Examiner*—Kevin Weldon

*Attorney, Agent, or Firm*—Speckman Pauley Peterson & Fejer

[57] ABSTRACT

A nozzle cone and an oscillating fluid-jet nozzle system capable of producing relatively high-velocity, high-frequency oscillating fluid jets useful in waterjetting and other industrial spray applications. The oscillating fluid jetting apparatus includes a conduit and a follower which is mounted with respect to the conduit. A cam mechanically drives the follower so that the cam moves with respect to the follower. A portion of the conduit is secured with respect to a housing. An inlet block is secured with respect to the housing. An inlet end portion of the conduit is secured with respect to the inlet block. The inlet block has a fluid inlet opening which is in communication with the conduit.

17 Claims, 8 Drawing Sheets

APPARATUS FOR GENERATING OSCILLATING FLUID JETS

BACKGROUND OF THE INVENTION

1. Field of the Invention

This invention relates to an oscillating nozzle system which is lightweight, has few moving parts, and can be used in relatively high-pressure waterjetting applications.

2. Description of Prior Art

A fluid jet, such as a waterjet, is commonly generated by pressurizing a fluid with a suitable pump, transporting the fluid with a tube or hose to a nozzle assembly, and discharging the fluid through one or more orifices. In some cases, only a delivered fluid is desired. In other cases, the kinetic energy contained in the fluid jets is utilized to do work. Many types of fluid jets are currently being used in industrial and commercial processes. For example, waterjets are used for extinguishing fires, washing and cleaning equipment and structures, mining minerals, blasting away contaminates, and cutting materials. Currently, waterjets generated at pressures up to about 40,000 psi are routinely used in industrial cleaning applications, such as removing scales, rust and old paint, as well as in construction processes such as removing deteriorated bridge deck and roadway concrete. Waterjets generated at pressures above about 40,000 psi are used in factories for cutting a wide variety of materials such as fruits, fish, meat, paper products, plastics, composites, textiles, leather and polymers.

More recently, waterjet processes draw selected particulates into the waterjet stream to generate a slurry jet. Soft, fibrous particulates such as crushed walnut shell or peanut shell are used to create the slurry jet, which removes oil, grease, paint, and other soft contaminants from a surface. Hard abrasives can be used to generate a slurry jet which can cut relatively hard materials such as concrete, glass, plastics, and metals. Currently, these processes are widely used in many industrial applications. U.S. Pat. Nos. 4,449,332 and 4,478,368 teach generating particulate-containing fluid jets capable of cutting relatively hard materials and blasting away relatively hard contaminants. U.S. Pat. No. 4,765,540 teaches generating multiple waterjets with or without particulates.

In many industrial cleaning and blasting applications a handheld jet lance, which in a simplest form can be a metal pipe having a suitable nozzle at one end, administers the waterjetting. The pressurized water is transported from a pump to the jet lance through a hose, and an operator manipulates the jet lance to direct the waterjet at a target. A firefighting nozzle system is an example of such a jet lance apparatus. A more sophisticated jet lance system can include a hand-operated flow control valve that can turn the pressurized water on or off with a hand-operated trigger lever, such as is disclosed in U.S. Pat. Nos. 5,092,362, 5,117,872, 5,186,393, and 5,297,777.

A waterjet lance system can further increase productivity with a special nozzle which generates a fan-shaped jet spray pattern, or issues multiple waterjets, to increase the impingement area of the waterjets.

A mechanism which imparts rotation or oscillation to the nozzle or nozzles so that the operator can achieve wide surface coverage without vigorous manipulation is a further improvement. Several approaches are currently used in waterjetting operations to provide rotating or oscillating waterjets. For example, U.S. Pat. No. 4,690,325 teaches the use of an air motor to rotate several nozzles via a rotary coupling. The apparatus of the '325 patent transports pressurized fluid from a stationary tube to a rotating spindle and subsequently to a nozzle or nozzles.

A common water rotary coupling can be found in lawn sprinkler heads in which the water spray generates the torque required to rotate a multiple-jet nozzle. At higher fluid pressures, design and construction of a rotary coupling becomes more difficult, at least partially because of the difficult fluid sealing requirements. Achieving proper sealing becomes more difficult as fluid pressure increases because the torque required from a motor to rotate the spindle of a rotary coupling also increases, rendering construction of a reliable rotary coupling difficult. At present, rotary couplings are available for waterjetting applications up to about 30,000 psi, but the practical rotating speed and the serviceable life of the spindle seal are very limited.

U.S. Pat. No. 4,683,684 teaches another apparatus for increasing the area of waterjet coverage via a rotary coupling. The '684 patent teaches the use of particulate-containing fluid-jet nozzles and two rotary joints, one rotary joint for the pressurized fluid and one rotary joint for the particulate flow. By combining such rotary couplings, two or more particulate-containing fluid-jet nozzles can be mounted on a common manifold and rotated with a motor to increase the area of waterjet coverage.

A circular or lateral oscillating motion of a nozzle can also achieve a greater jet impingement area. Such approach requires an external source of energy such as pressurized hydraulic fluid, compressed air, or electricity to power a motor and to rotate a cam or other suitable elements to impart the desired oscillating motion to the nozzle tube. U.S. Pat. No. 4,369,850 teaches imparting oscillating motion to a fluid-jet cutting and drilling nozzle. The advantage of the oscillating nozzle approach is primarily the lack of a rotary joint and therefore the absence of a need to seal a rotating spindle.

Also known are handheld waterjet lances that are equipped with an orbital motor to provide circular motion to a nozzle that discharges multiple waterjets. In some lances, a flexible hose replaces the rigid lance tube to facilitate the oscillation. All such circular oscillating nozzle approaches include a motor and orbital gearing arrangement which use one or more sets of ball bearings that require sealing and protection from ambient contaminants. Such sealing requirements are troublesome in waterjetting environments. Therefore, a simpler and more reliable oscillation approach would be of significant value in waterjetting operations.

There are other known oscillating nozzle systems used in waterjetting applications which involve lateral oscillating motion of a nozzle tube. A rotating chain-induced sliding tube or rotating cam-induced tube can impart the oscillating motion. Such systems are generally used to provide oscillating motion of low frequency and high width, and are well suited for only limited applications.

In waterjetting applications, productivity is directly related to the design and performance of the nozzle. Waterjets that have a high velocity and coherence, an optimum flow rate, and an optimum impingement pattern result in high productivity in waterjet cleaning and blasting operations. A jet pattern in which the water spreads out like a fan is desirable. Forming a slit-shaped orifice or incorporating non-symmetrical flow drag through the orifice throat are conventional methods for producing fan-shaped jet spray patterns. Such conventional methods destroy the coherence of the fluid jet and turn an otherwise coherent jet into a droplet jet at certain angles. Such fan jet nozzles are currently being used for washing cars and other relatively low-pressure waterjetting applications. At fluid pressures above about 10,000 psi, such conventional fan-jet nozzles have a relatively short lifespan and alternative approaches are desired.

SUMMARY OF THE INVENTION

It is one object of this invention to provide fluid-jet nozzle assemblies which are lightweight, simple to use, and are capable of producing multiple, relatively high-velocity fluid jets that fan out in a single plane at desirable angles and thus increase the water impingement area.

It is another object of this invention to provide an improved oscillating fluid-jet nozzle system which produces multiple relatively high-velocity fluid jets that oscillate at relatively high frequencies.

It is yet another object of this invention to provide an improved fluid-jet nozzle system which produces oscillating fluid jets useful in high-pressure waterjetting applications.

It is still another object of this invention to provide both linear and orbital oscillating fluid-jet systems for use in a wide variety of high-pressure waterjetting applications.

According to one preferred embodiment of this invention, the fluid-jet nozzle assembly includes an orifice cone having a tapered top surface and a flat bottom surface. A plurality of fluid-jet passages are machined within the orifice cone at angles to provide a desirable overall spray angle of fluid jets. A hardened jewel orifice plate having a precisely machined center orifice is affixed in each of the fluid-jet passages with a suitable adhesive. Such jewel orifice plates produce fluid jets of high velocity and coherence at relatively high fluid pressures.

According to another preferred embodiment of this invention, a relatively simple and lightweight oscillating nozzle system achieves relatively high-frequency oscillations even at relatively high fluid pressures. The nozzle system can include a casing which at least partially houses a lance conduit. The lance conduit extends from an inlet block positioned at one end of the casing through an oscillating mechanism positioned at an opposite end of the casing, and terminates in a nozzle. The lance conduit carries a pressurized fluid, such as water. The oscillating mechanism is preferably housed within the casing and includes a follower which is biased by both a spring and a cam. A motor can be housed internally or externally of the casing and can be driven by a pressurized fluid or electricity. A motor shaft extends from the motor and rotates the eccentric, thus imparting a back and forth sliding movement to the follower, and through the follower a back and forth movement to the lance conduit. The biasing spring assures proper engagement between the eccentric and the follower.

According to another preferred embodiment of this invention, a handheld oscillating nozzle system is provided. An inlet block houses a trigger-operated valve for on-off operation of the pressurized waterjetting fluid. The oscillating motor can also have an on-off trigger or handle for controlling on-off operation of the oscillating mechanism.

According to yet another preferred embodiment of this invention, an orbitally oscillating nozzle system has a drive disk and a cam disk housed in a nozzle system casing. The motor shaft rotates the drive disk which is mechanically coupled to the cam disk, such as directly through gear teeth or indirectly by a drive belt or drive chain. A plurality of rollers peripherally support the cam disk. The cam disk contains an off-center hole through which the lance conduit is positioned. As the cam disk rotates, the lance conduit oscillates orbitally about the geometric center of the cam disk. The geometric center of the cam disk is preferably axially aligned with the center of the fixed end of the lance conduit. The orbital oscillating mechanism according to this invention does not require ball bearings, has relatively few moving parts, and thus is very reliable.

According to another preferred embodiment of this invention, an orbitally oscillating nozzle system has a drive disk driven by a working fluid. The drive disk has an off-center hole through which the lance conduit is positioned. A plurality of recesses, such as indents or teeth, are positioned about a peripheral surface of the drive disk. The drive disk is mounted in a circular cavity within the system casing. The working fluid is discharged through a fluid inlet tangentially to the drive disk to contact the peripheral recesses and thereby rotate the drive disk. A circular fluid passage in communication with the fluid inlet and a fluid outlet is preferably formed in the system casing about the periphery of the drive disk. The oscillating nozzle system according to such preferred embodiment eliminates a need for a working motor, and can be driven by practically any pressurized fluid.

BRIEF DESCRIPTION OF THE DRAWINGS

These and other features of this invention will be better understood when viewed in light of the following detailed description taken in conjunction with the drawings wherein.

DESCRIPTION OF PREFERRED EMBODIMENTS

Figure 1:
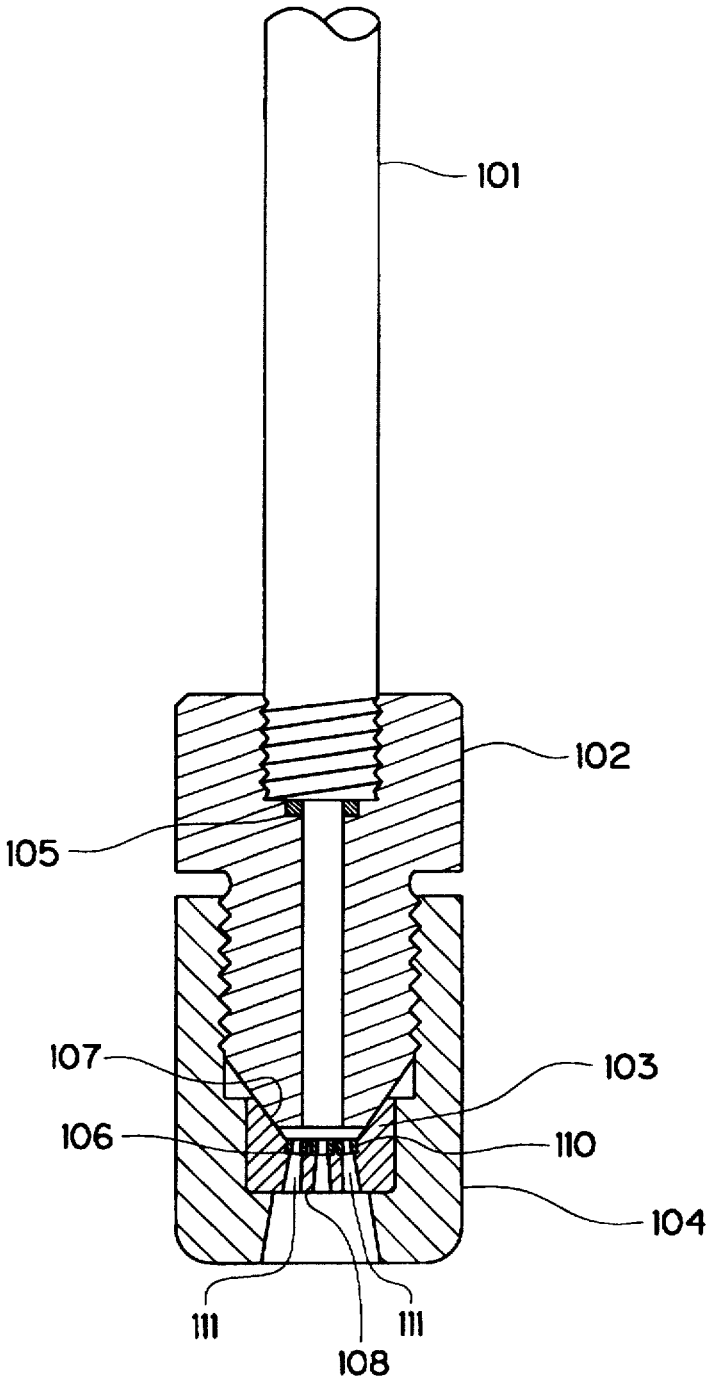
FIG. 1 shows a partial cross-sectional lateral view of a fluid-jet nozzle assembly which generates jets that fan out in a single plane at desired angles, according to one preferred embodiment of this invention.

The nozzle system according to this invention has relatively few parts and operates particularly well in high-pressure fluid-jet applications in which fluid sealing is critical and the total size and weight of the assembly must be minimized. Further, the nozzle system according to this invention provides multiple orifice plates of high quality and long life capable of producing relatively high velocity, coherent fluid jets that have an overall fan-shaped spray pattern.

The terms top, bottom, sides, upper, lower and the like as discussed throughout this specification and in the claims are intended to be relative to the orientations shown in the drawings, and are not necessarily relative to a normal direction of gravity.

Referring to one preferred embodiment of this invention as shown in FIG. 1, the nozzle system according to this invention comprises a pressure hose or lance conduit 101 connected to conduit-nozzle adapter 102. Seal 105 can be positioned between conduit-nozzle adapter 102 and lance conduit 101. Orifice cone 103 preferably has a tapered top portion 107 in which one or more jewel orifice plates 106 is mounted. Orifice cone 103 has a flat bottom portion 108, and nozzle cap 104 preferably a mating surface that supports orifice cone 103. Conduit-nozzle adapter 102 preferably has a tapered bottom portion to provide an intimately mated fit with tapered top portion 107 of orifice cone 103, and thus forms a fluid-tight seal. Conduit-nozzle adapter 102 preferably has external threads which engage with internal threads of nozzle cap 104 and provide support for seating orifice cone 103 as well as for providing a sufficient sealing force. Orifice cone 103 has multiple machined cavities 110 and fluid passages 111 positioned for generating a desired spray pattern.

Figure 2:
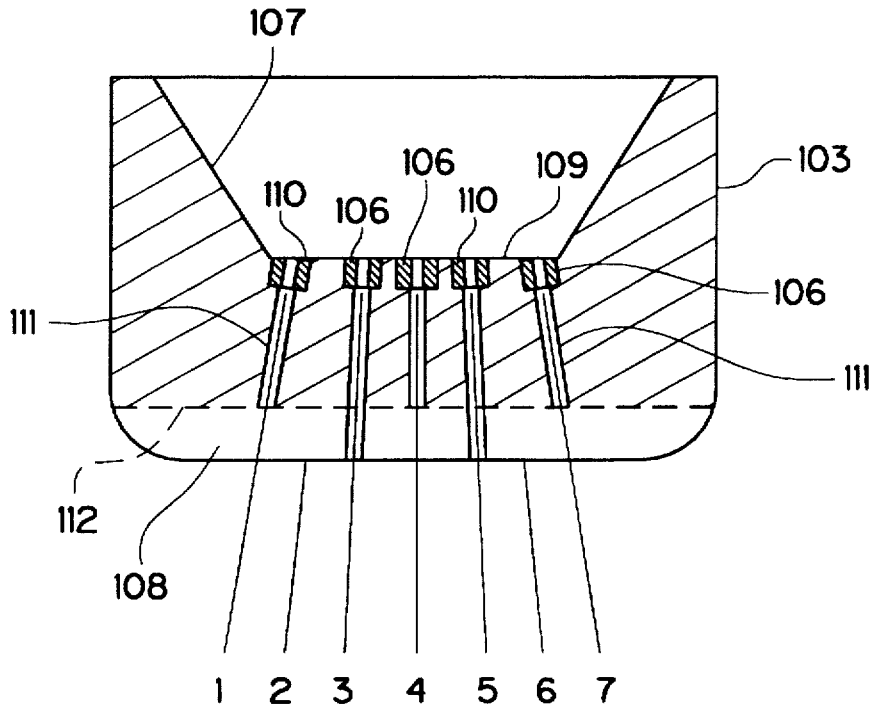
FIG. 2 shows a side plan view of an orifice cone having multiple jewel-quality plates mounted in passages which fan out at angles corresponding to desired fluid jet directions.

Referring to FIG. 2, according to one preferred embodiment of this invention orifice cone 103 is a circular disk constructed of steel, stainless steel or another suitable hard material and has a tapered top portion 107 and a flat bottom portion 108. Orifice cone 103 preferably has a central flat circular surface 109 with multiple machined cavities 110 and drilled fluid passages 111. Jewel orifice plates 106 are constructed of relatively hard materials including sapphire, ruby, ceramics, and diamond, and have a precisely drilled or otherwise machined center orifice of a desired size and geometry. Jewel orifice plates 106 are adhered or cemented within cavities 110 with suitable adhesives. Jewel orifice plates 106 produce fluid jets of high velocity and coherence at relatively high fluid pressures with assured long service life.

Figure 3:
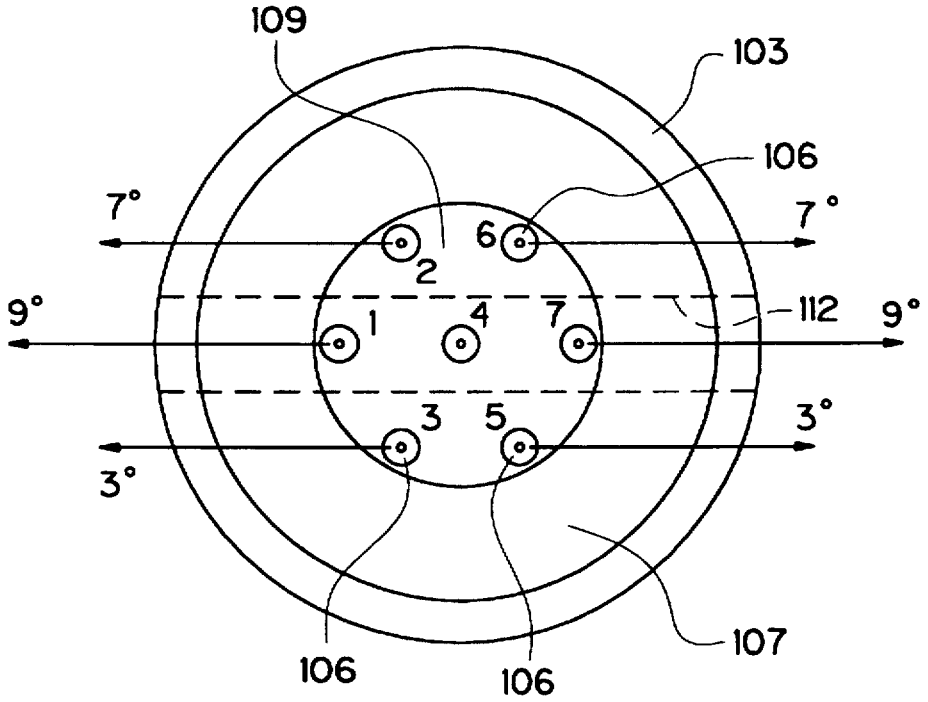
FIG. 3 shows a top view of an orifice cone which generates a seven jet spray pattern having a fan angle of about eighteen degrees, according to one preferred embodiment of this invention.

Referring to FIG. 3, orifice cone 103 preferably has multiple jewel orifice plates 106 mounted in fluid passages 111 which form circular or other desired patterns. The off-center fluid passages 111 preferably fan out at desired angles from the axial center of orifice cone 103. One desirable pattern includes seven jewel orifice plates 106 positioned at various angles to form an approximately eighteen degree fan-shaped jet pattern. Screwdriver slot 112 can be formed on the bottom of orifice cone 103 to indicate the direction of the fan-shaped pattern and to allow easy positioning of orifice cone 103 with respect to nozzle cap 104.

The number of fluid passages 111 incorporated in orifice cone 103 is determined by the size of fluid passages 111, the available pressure and flowrate of a supply pump, the desired division of the available flow from the supply pump, and the optimum size of orifice cone 103. In common waterjetting operations, the number of fluid passages 111 in a single orifice cone 103 preferably ranges from about three to about twelve. The angles of jewel orifice plates 106 and fluid passages 111 with respect to an axis of orifice cone 103 are based primarily on an even distribution of the fluid jets. An overall spray angle can vary from a few degrees to about 40 degrees, depending on available flow, job requirements, and other factors.

The multiple jet nozzle system according to this invention can provide improved productivity in fluid-jet processes such as waterjetting operations when used in conjunction with conventional jet lances, either with or without rotating or oscillating movement. However, the nozzle system according to this invention is particularly advantageous when used with the oscillating method and apparatus of this invention which provides more reliable, high-frequency oscillations than conventional oscillating systems.

Figure 4:
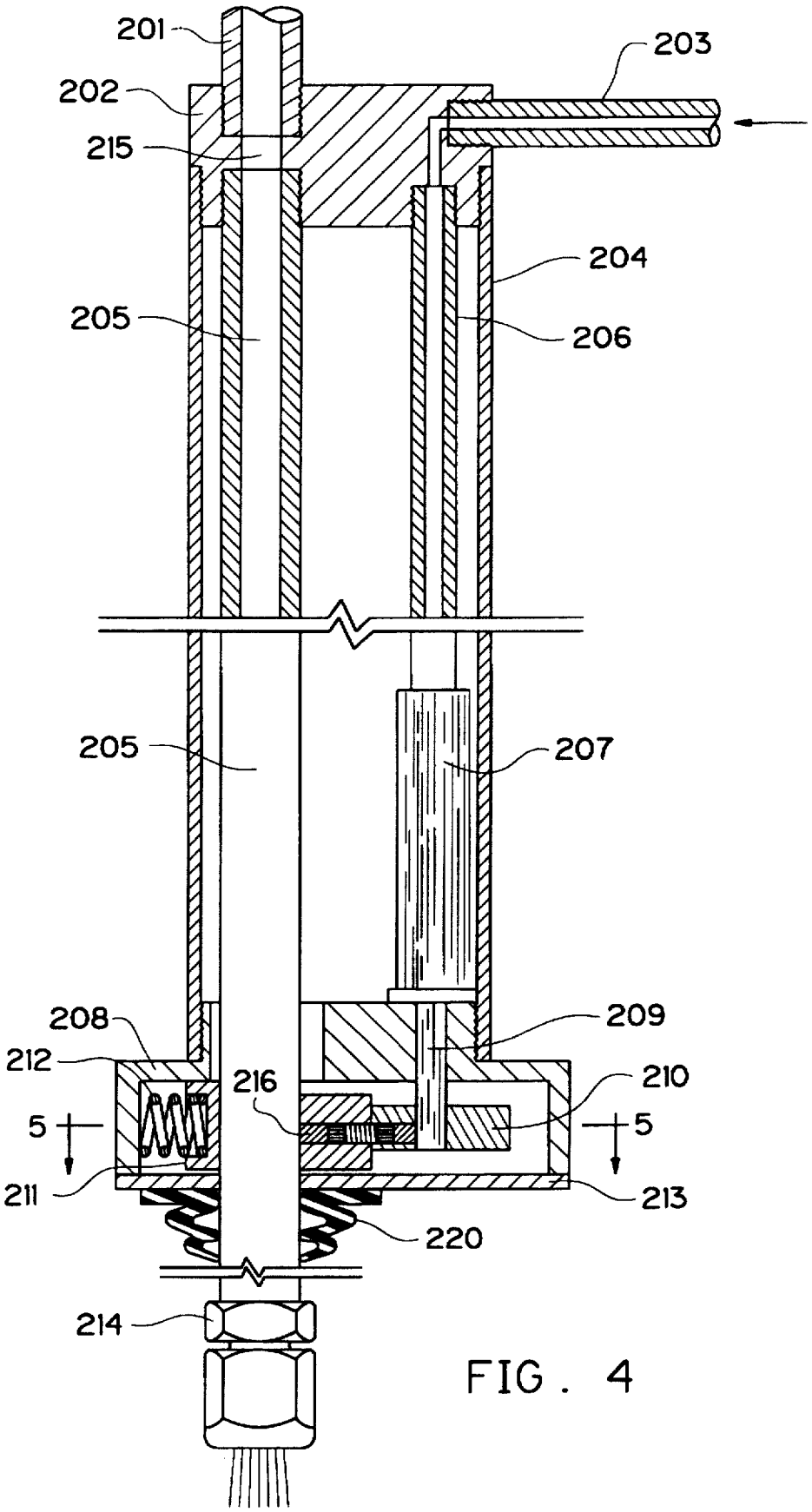
FIG. 4 shows a partial cross-sectional side view of an oscillating nozzle system which produces relatively high-frequency oscillating motion of a fluid-jet lance conduit, according to another preferred embodiment of this invention.

Referring to FIG. 4, the oscillating nozzle system of this invention comprises relatively few simple components: inlet tube or conduit 201 for a system fluid, inlet block 202 which serves as an inlet anchor end of the system, inlet working fluid hose or conduit 203, metallic or plastic casing 204 which serves as the body of the oscillating nozzle system, lance conduit 205 of a desired size and length for transporting the pressurized system fluid to nozzle 214, connecting conduit 206 for transporting pressurized working fluid such as compressed air or hydraulic fluid, compact motor 207, and outlet block 208 connected to the outlet end of casing 204 to house the oscillating mechanism according to this invention. Inlet block 202 shown in FIG. 4 also acts as a securement means for securing a portion of conduit 201 with respect to casing 204. It is apparent that a portion of conduit 201 can threadedly engage inlet block 202, or can be fixed in inlet block 202 by any other suitable means apparent to those skilled in the art. The oscillating mechanism preferably includes cam 210, follower 211 and compression spring 212 which can be protected from the environment with end cover 213. Nozzle 214 preferably generates a multiple, fan-shaped jet pattern.

As shown in FIG. 4, one end of lance conduit 205 is connected in fluid-tight fashion to inlet block 202 and thus communicates with fluid passage 215, and the other end of lance conduit 205 is connected to nozzle 214 in fluid-tight fashion as well. Preferably, but not necessarily, the majority of lance conduit 205 is positioned inside casing 204. It is apparent that casing 204 can have any suitable cross section, including a circular or rectangular cross section. Lance conduit 205 is preferably made of tough and ductile materials such as certain grades of stainless steel so lance conduit 205 can be repeatedly deflected without fatigue failure. Connecting conduit 206 communicates the working fluid to fluidic-type motor 207. The working fluid can comprise compressed air, pressurized gas, pressurized hydraulic fluid, pressurized water, a pressurized mixture of air and water, or any other suitable fluid.

According to another preferred embodiment of this invention, motor 207 is powered with electricity and an electric cable replaces inlet working fluid conduit 203 and connecting conduit 206. Motor 207, depending on its size and shape, can be mounted inside or outside casing 204. Since the power requirement of the oscillating mechanism according to this invention is very low, compact air motors are ideally suited. However, motors powered with pressurized water or a pressurized mixture of water and air can also be particularly advantageous in waterjetting operations. Outlet block 208 also serves as an end cap for casing 204 and preferably has a slotted end cover 213 which accommodates lance conduit 205. Rubber or plastic conduit boot 220 can be provided to prevent contaminants from entering outlet block 208.

Figure 5:
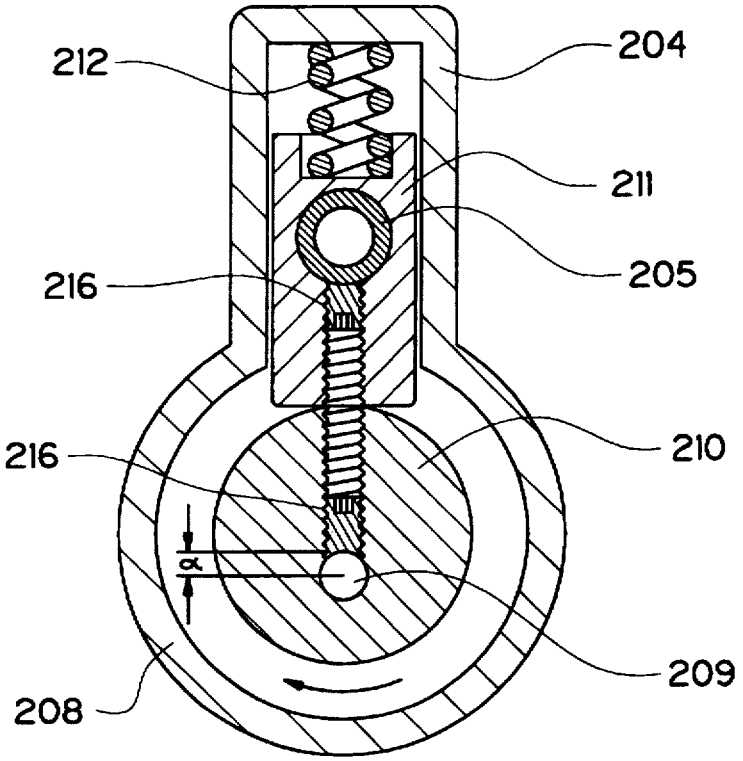
FIG. 5 shows a cross-sectional view taken along line 5—5 of FIG. 4 of an oscillating mechanism, according to one preferred embodiment of this invention.

Referring to FIG. 5, the oscillating mechanism according to this invention comprises relatively simple components, such as essentially only three basic elements: circular cam 210 constructed of durable, low-friction metal or plastic, drive means for rotating cam 210, follower 211 preferably constructed of similar material as cam 210 and installed about lance conduit 205 for engaging cam 210, and return compression spring 212 for providing a bias force to lance conduit 205. According to one preferred embodiment of this invention, the drive means includes motor 207 having motor shaft 209 which is securably mounted within an off-center bore formed in cam 210. It is apparent to those skilled in the art that other conventional means can be used to rotate cam 210. Set screws 216 can be used to secure cam 210 with respect to motor shaft 209 and to secure follower 211 with respect to lance conduit 205. As cam 210 rotates, the eccentric rotation imparts a back and forth sliding movement to follower 211 and thus oscillating movement to lance conduit 205. Bias spring 212 is used to form continuous contact between cam 210 and follower 211. The frequency of the oscillating movement of lance conduit 205 is preferably the same as the rotational frequency of motor 207. The overall length of the oscillating stroke of lance conduit 205 is a function of the distance between the center of motor shaft 209 and the geometric center of cam 210. Since the force required for moving lance conduit 205 is relatively low, the required torque power of motor 207 is also relatively low. Thus, a compact, low-power motor 207 can provide sufficient torque. The oscillating mechanism according to this invention is very reliable because there are no gears or ball bearings which require protection or maintenance.

Figure 6:
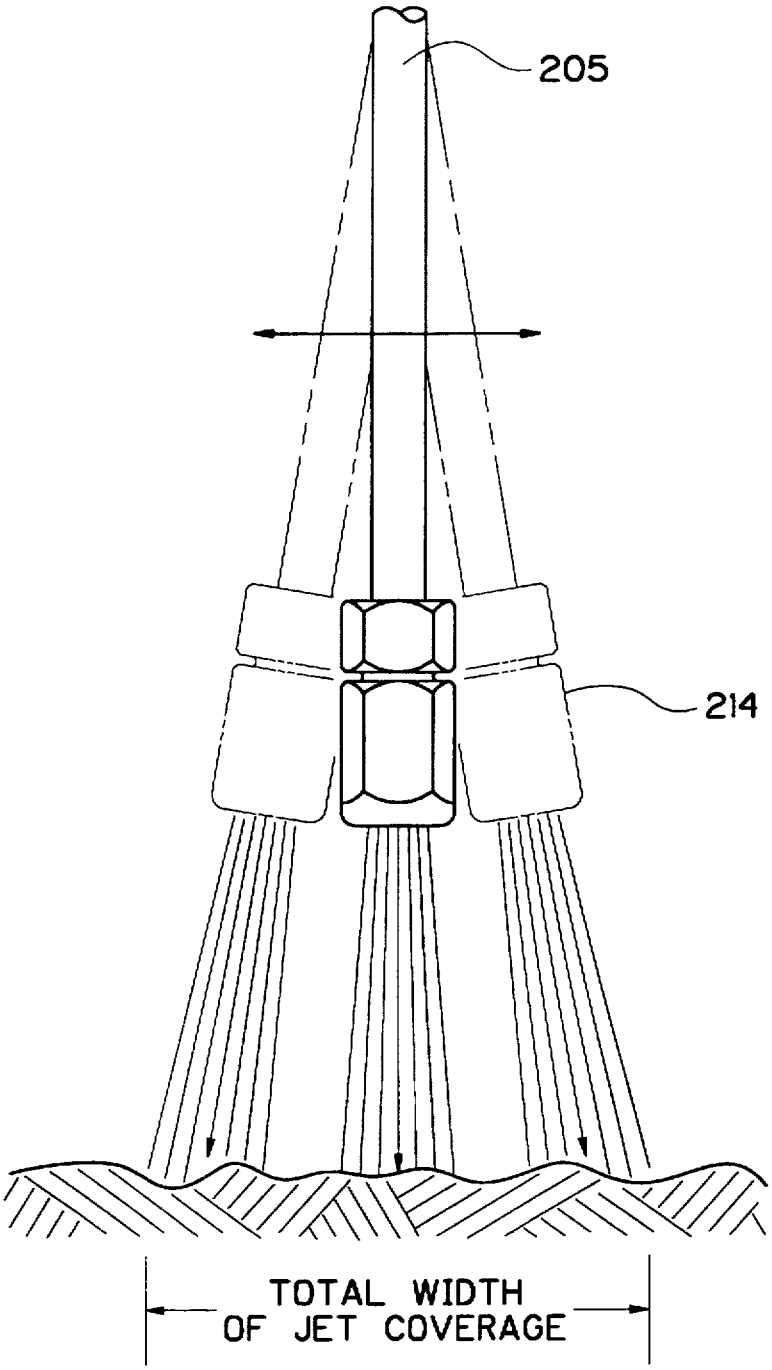
FIG. 6 shows a spray pattern of an oscillating jet nozzle of this invention.

FIG. 6 shows a sample spray pattern of the oscillating nozzle system according to one preferred embodiment of this invention. Thus, the oscillating nozzle system according to this invention is well suited for industrial waterjetting applications in which a large waterjet impingement area is synonymous with high productivity. While orifice cone 103 according to this invention by itself leads to improved productivity, the oscillating mechanism according to this invention in combination with orifice cone 103 results in even a larger improvement in productivity. According to one preferred embodiment of this invention, an oscillating nozzle system can be mounted inside a cleaning chamber, and the oscillating waterjets can be directed toward a moving or rotating target, to assure high productivity. For waterjetting a very large surface area, such as the surface of a ship or of an aircraft, the oscillating nozzle system can be mounted on a moving carriage which moves in a direction perpendicular to the direction of nozzle oscillation.

High productivity with handheld waterjetting lances depends on several factors, including the ease of use of the lance and the skill of the operator. With conventional non-oscillating jet lances, the operator must manually manipulate the jet lance rapidly in an up-and-down, circular, or lateral motion to achieve a large area of coverage. If the jet lance is heavy, this repetitive manual movement can exhaust the operator and increase the dangers associated with waterjetting. Thus, a jet lance having an automatic oscillating or rotating capability is highly desirable. The oscillating jet lance according to this invention achieves such a jet lance which is lightweight and functional as well.

Figure 7:
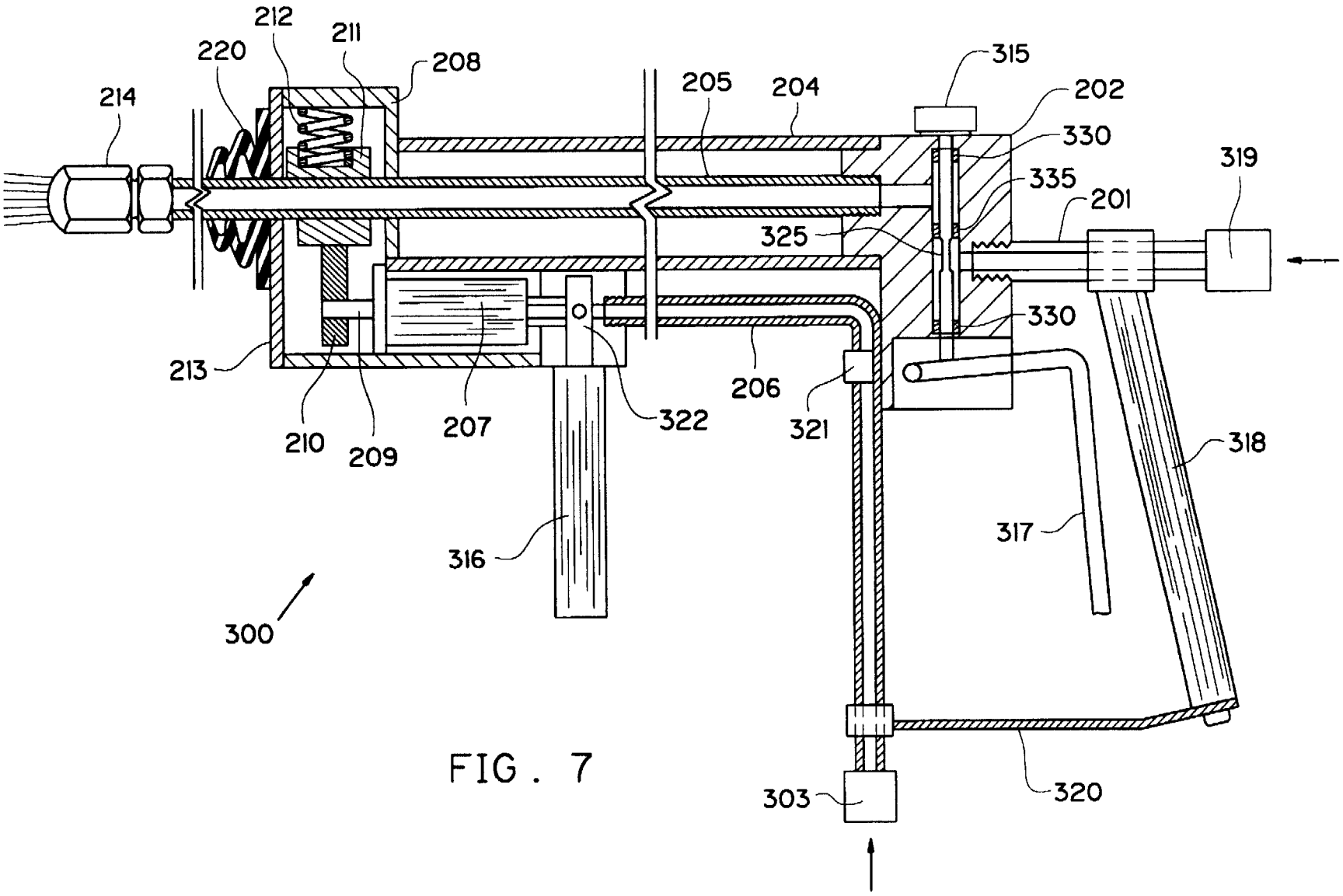
FIG. 7 shows a partial cross-sectional side view of a handheld oscillating fluid-jet nozzle system having hand-operated on-off valves for both a system fluid and a working fluid.

FIG. 7 shows an oscillating nozzle system according to one preferred embodiment of this invention which is well suited for handheld waterjetting applications. Such an oscillating nozzle system can also include a hand-operated on-off valve. A handheld oscillating nozzle system 300, as shown in FIG. 7, has an overall design similar to the oscillating nozzle system shown in FIG. 4, and includes a hand-operated on-off valve for system fluid and for working fluid. The system fluid, for example pressurized water, enters inlet conduit 201 through a conduit adapter 319. Inlet conduit 201 is connected to inlet block 202 which houses an on-off valve 315, valve seals 330, and chamber seals 335. An outlet of inlet block 202 is connected to an inlet end of lance conduit 205. Inlet block 202 is also attached rigidly to one end of lance casing 204. A trigger lever 317 pivots with respect to a handle bar 318 and operates on-off valve 315. Handle bar 318 can be attached to inlet conduit 201. Pulling trigger lever 317 toward handle bar 318 opens on-off valve 315 by positioning fluid passages 325 between chamber seals 335 and allows system fluid to travel through lance conduit 205 to nozzle 214.

The oscillating nozzle system according to such preferred embodiment of this invention as shown in FIG. 7 preferably comprises compact motor 207, which is powered by electricity, compressed air, pressurized gas, pressurized hydraulic fluid, pressurized water, a pressurized mixture of water and air or any other suitable means. Motor 207 can be equipped with hand-operated on-off valve 322 which includes hand grip 316, or an electrical switch if an electric motor 207 is used. Connecting conduit 206 similar to that shown in FIG. 4 supplies the working fluid to motor 207 from an external source through inlet adapter 303. Trigger guard 320 and tube anchor 321 provide rigidity to connecting conduit 206. As shown in FIG. 7, an oscillating mechanism similar to the oscillating mechanism shown in FIG. 4 oscillates lance conduit 205. The oscillating mechanism comprises circular cam 210 attached eccentrically to motor shaft 209, follower 211 positioned about lance conduit 205, and return spring 212 for biasing follower 211. Outlet block 208 houses the oscillating mechanism and conduit boot 220 seals outlet block 208. To operate the oscillating nozzle system according to one preferred embodiment of this invention as shown in FIG. 7, the operator holds handle bar 318 with one hand and holds hand grip 316 with the other hand. Thus, one of the operator's hands operates the high-pressure water or other system fluid from a supply pump to nozzle 214, while the other hand operates the oscillating mechanism.

Figure 8:
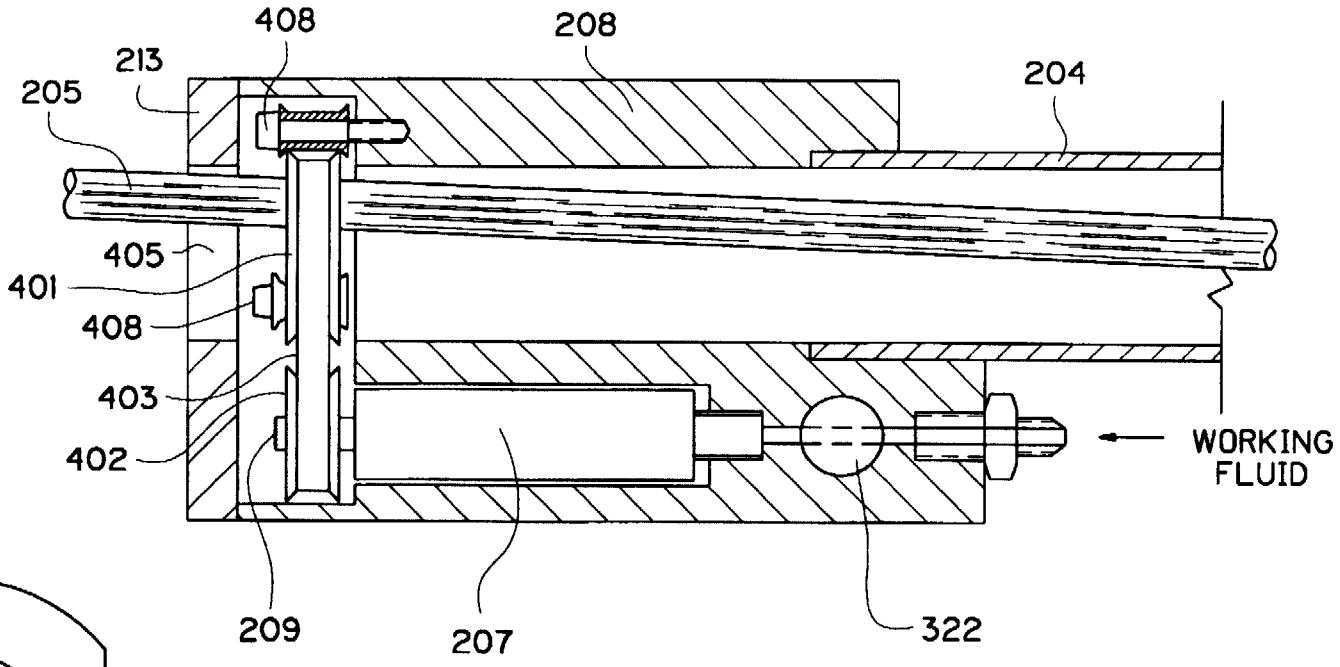
FIG. 8 shows a partial cross-sectional side view of an oscillating fluid-jet system according to another preferred embodiment of this invention.
Figure 9:
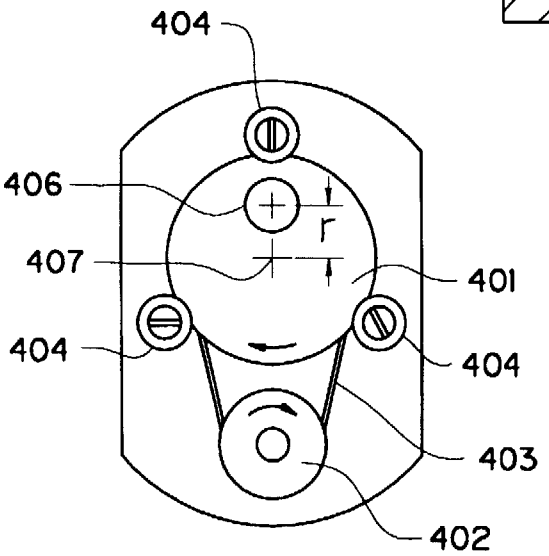
FIG. 9 shows a schematic view of the orbitally oscillating mechanism of the oscillating fluid-jet system shown in FIG. 8.

FIGS. 8 and 9 show an orbitally oscillating nozzle system according to another preferred embodiment of this invention. Similar to the oscillating nozzle system shown in FIG. 7, the orbitally oscillating nozzle system shown in FIG. 8 has a tube casing 204 that houses lance conduit 205. The oscillating nozzle system shown in FIGS. 8 and 9 can have a hand-operated on-off valve 322 which is represented by a circle in FIG. 8 but can be similar to the hand-operated on-off valve 322 shown in FIG. 7. The oscillating nozzle system shown in FIG. 8 can also have an on-off valve 315 and trigger lever 317, similar to those shown in FIG. 7. The oscillating nozzle system shown in FIG. 8 preferably comprises outlet block 208 which houses compact motor 207, hand-operated on-off valve 322, follower disk 401, cam disk 402, drive belt or drive chain 403, and support rollers 404. End cover 213 with opening 405 is positioned on outlet block 208 to accommodate orbitally oscillating conduit 205. Cam disk 402 is mounted to motor shaft 209 and engages follower disk 401 either directly by gear teeth or preferably indirectly by drive belt or drive chain 403. A plurality of rollers 404, preferably three as shown in FIG. 9, peripherally support follower disk 401. As motor shaft 209 rotates, follower disk 401 rotates at a rate which is a function of the speed of motor 207 and a diameter ratio of follower disk 401 to cam disk 402.

Follower disk 401 has off-center hole 406, shown in FIG. 9, which accommodates lance conduit 205. Hole 406 is positioned at a distance r away from a geometric center 407 of follower disk 401. As follower disk 401 rotates, lance conduit 205 orbitally oscillates about center 407 of follower disk 401. Center 407 preferably corresponds longitudinally to the axial center of the fixed end of lance conduit 205. Rollers 404 are preferably rotatably mounted with respect to outlet block 208, such as with shoulder bolts 408. Rollers 404 can be constructed of relatively high-strength and low friction plastic, ceramic or other suitable material. Follower disk 401 is preferably constructed of a relatively high-strength plastic or other suitable material. According to one preferred embodiment of this invention, cam disk 402 is constructed entirely of metal, or is constructed of a relatively high-strength plastic with a metal core.

The orbital oscillating mechanism according to one preferred embodiment of this invention requires no ball bearings, and is simple, reliable, and very easy to maintain. Mating the orbitally oscillating mechanism, according to one preferred embodiment of this invention, with a hand-operated on-off valve 322 to control the operation of motor 207 and an on-off valve similar to on-off valve 315 shown in FIG. 7 achieves a highly effective waterjetting nozzle.

Figure 10:
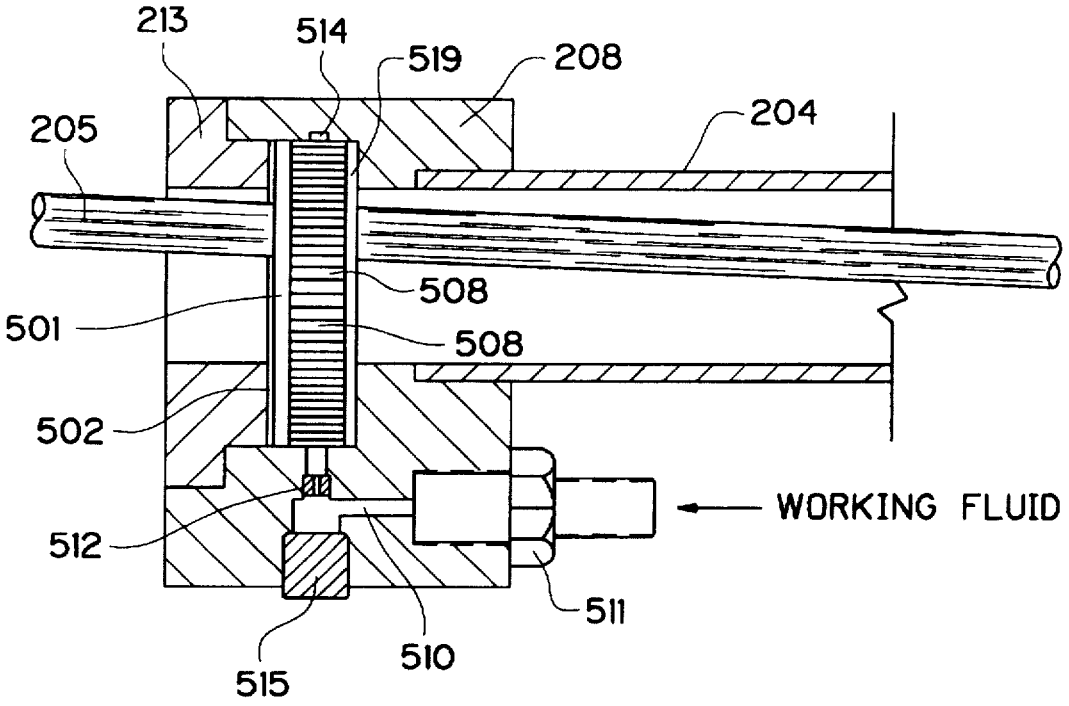
FIG. 10 shows a partial cross-sectional side view of an oscillating fluid-jet system according to another preferred embodiment of this invention.

FIG. 10 shows a partial cross-sectional side view of an orbitally oscillating fluid-jet system according to another preferred embodiment of this invention. The oscillating nozzle system shown in FIGS. 10–12 can include a hand-operated on-off valve 322 and an on-off valve 315 and trigger lever 317, similar to those shown in FIG. 7. Casing 204 houses lance conduit 205. Outlet block 208 comprises a generally circular cavity 502 which provides a close fit for follower disk 501. Although circular cavity 502 is preferably only slightly larger than follower disk 501, follower disk 501 freely rotates within circular cavity 502. Off-center hole 506 is positioned at a distance r from the geometric center 507 of follower disk 501. Off-center hole 506 accommodates conduit 205. A plurality of machined indents 508 or teeth 509 are peripherally positioned about a circumferential surface of follower disk 501. The indents 508 or teeth 509 engage the working fluid, as described below, and generate a torsion force that rotates follower disk 501. The shape and pattern of indents 508 and/or teeth 509 can vary but are preferably positioned between two outer ridges 519 which intimately fit within cavity 502 and help guide the working fluid about the periphery of follower disk 501.

Figure 11:
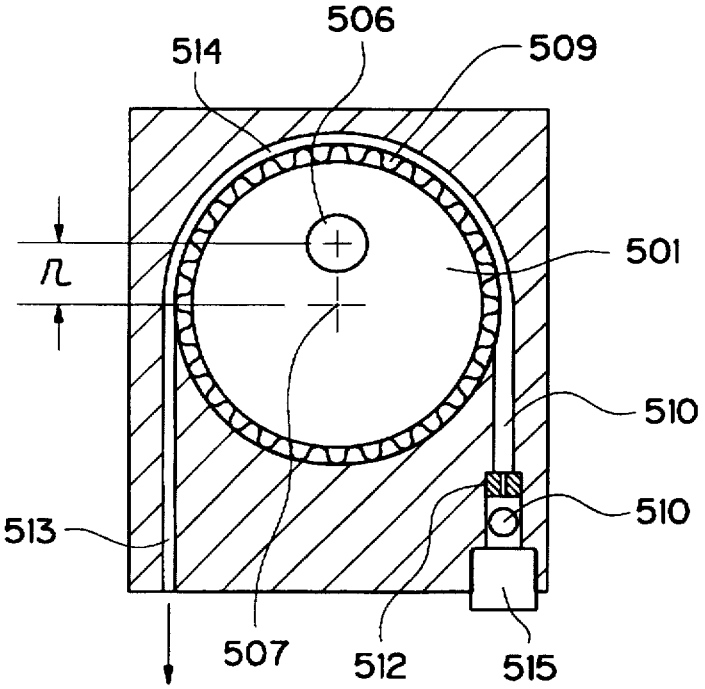
FIG. 11 shows a schematic front view of the orbitally oscillating mechanism of the oscillating fluid-jet system shown in FIG. 10.

Fluid inlet 510 is positioned in outlet block 208. One end of fluid inlet 510 is in fluid communication with inlet fitting 511 for receiving a working fluid. Another end of fluid inlet 510 is in fluid communication with cavity 502. Flow controller 512, such as an orifice plate, is preferably positioned between and in communication with fluid passage 510 and cavity 502 for controlling the flow rate and flow velocity of the working fluid. As shown in FIG. 11, fluid outlet 513 is positioned in outlet block 208 in a manner that forms communication between cavity 502 and the ambient environment. Fluid inlet 510 and fluid outlet 513 are preferably positioned to allow fluid to tangentially flow to cavity 502 and face indents 508. Circular fluid passage 514 is preferably formed in the interior surface of outlet block 208 which forms cavity 502 and is preferably in communication with fluid inlet 510 and fluid outlet 513. Fluid passage 514 facilitates the flow of working fluid about follower disk 501. Cover 213 seals cavity 502 and helps maintain follower disk 501 within cavity 502. Cover 213 preferably has a central opening which accommodates lance conduit 205.

Figure 12:
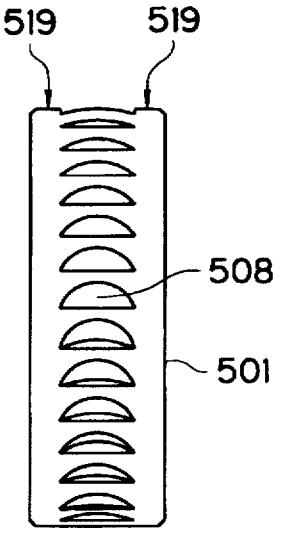
FIG. 12 shows a schematic side view of the follower disk shown in FIG. 10.

The orbital oscillating mechanism according to the preferred embodiment of this invention shown in FIGS. 10–12 achieves rotation of follower disk 501 directly from a working fluid without a need for a working motor. Preferred working fluids include compressed air, pressurized water, or a mixture of compressed air and pressurized water, although it is apparent to those skilled in the art that any pressurized fluid could be used to drive follower disk 501. The working fluid enters fluid inlet 510 and passes through flow controller 512 to generate a fluid-jet impacting directly on indents 508. Flow controller 512 is preferably interchangeable. Plug 515 can be provided to facilitate the interchangeability of flow controller 512.

The fluid-jet discharged at flow controller 512 flows about the periphery of follower disk 501 and into indents 508, and transfers energy to follower disk 501 in the form of a rotary motion. As follower disk 501 rotates, lance conduit 205 orbitally oscillates. The magnitude of force required to oscillate lance conduit 205 is relatively low, and thus the energy required from the working fluid is also relatively low. Further, fluid leakage about cam disk 501 is not problematic and thus sophisticated sealing is not required. Outlet block 208 can be constructed of metals, plastics, or other suitable materials known to those skilled in the art. Follower disk 501 can also be constructed of metals, plastics, or other materials suitable to those known in the art, depending on the particular working fluid and system power required.

EXAMPLE

An oscillating nozzle system similar to that shown in FIG. 7 was constructed and tested. Inlet conduit 201 was a 9/16 inch diameter stainless steel tube with a 0.188 inch bore threaded into inlet block 201. Inlet block 201 had an on-off valve 315 designed and constructed according to U.S. Pat. No. 5,297,777, the entire teachings of which are incorporated herein by reference, with a valve-operating trigger lever 317 constructed of a ⅛ inch diameter stainless steel rod and a handle bar 318 constructed of ⅞ inch diameter aluminum alloy. Lance casing 204 was constructed of a 20 inch length of 1 inch by 2 inch rectangular aluminum alloy tube. Lance conduit 205 was 30 inches in length and was constructed of ⅞ inch diameter stainless steel tube having a 0.125 inch bore which was threaded into the outlet of inlet block 201. A compact air-operated gear motor 207 was used to power the oscillating nozzle system. Motor 207 was geared to provide a maximum free speed of 450 rpm (revolutions per minute) and a maximum stall torque of 440 inch-ounce, and required about 4.0 C.F.M. (cubic feet per minute) of air at 60 psi (pound per square inch) air pressure. Therefore, a relatively small air compressor sufficed for supplying the compressed air. Cam 210 and follower 211 were constructed of Teflon-containing Acetal plastic. Cam 210 was 1.250 inches in diameter, 0.500 inches in thickness, and was designed to provide a maximum overall displacement of 0.500 inches to lance conduit 205 via follower 211. Follower 211 was rectangular in shape and had a center throughbore for accommodating lance conduit 205. Follower 211 had dimensions of 1.000 inches by 0.750 inches by 0.650 inches. A stainless steel compression spring 212, 0.63 inches in diameter and 0.750 inches in length was used to provide the required bias force. The oscillating mechanism provided a maximum oscillating frequency of about 450 rpm. A hand-operated rotary valve 322 and hand grip 316 were made of modified nylon plastic. End block 208 was also made of modified nylon plastic to provide an impact-resistant and lightweight housing.

A nozzle 214 was constructed according to the design shown in FIGS. 1–3. Seven sapphire orifice plates 106, each having a 0.010 diameter inch throughbore were used to construct orifice cone 103, which had a fan-shaped spray pattern having an overall angle of about eighteen degrees. Orifice cone 103 was constructed of stainless steel and was 0.600 inches in diameter. Nozzle cap 104 and conduit-nozzle adapter 102 were constructed of a hexagonal piece of 1 inch stainless steel and the nozzle assembly had an overall length of 1.5 inches.

The oscillating nozzle assembly was tested at water pressures up to about 30,000 psi. Compressed air at 60 psi was utilized to power oscillating motor 207. The oscillating nozzle system according to this invention performed flawlessly. Hand-operated on-off valve 315 was easy to use and successfully turned the pressurized water on and off at will by pulling and releasing trigger lever 317. The oscillating mechanism provided an oscillating motion of a preferable frequency without generating undesirable shakes and vibrations. Waterjet nozzle 214 generated powerful waterjets of high speed and coherence. The seven waterjets formed a fan-shaped spray pattern that formed a single fan-shaped jet stream. At a nozzle standoff distance of about 20 inches, a jet impingement area having an overall width of about 12 inches was achieved. The overall weight of the constructed oscillating waterjet nozzle system was less than 10 pounds.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

I claim:

1. An oscillating fluid jetting apparatus comprising:

a conduit, a follower mounted with respect to said conduit;

a cam, said follower mechanically driven by said cam, drive means for moving said cam with respect to said follower;

a housing, an inlet block secured with respect to said housing, an inlet end portion of said conduit secured with respect to said inlet block, said inlet block having a fluid inlet opening in communication with said conduit, said inlet block having a valve bore, a valve stem slidably mounted within said valve bore, said valve stem having a valve port, and in an open position of the valve stem, said valve port, said fluid inlet opening and said conduit in fluid communication.

2. An oscillating fluid jetting apparatus according to claim 1, further comprising: a lever pivotally mounted with respect to said inlet block, said valve stem contacting said lever and pivotal movement of said lever moving said valve stem between a normally closed position and said open position.

3. An oscillating fluid jetting apparatus according to claim 1, wherein said drive means comprise: a motor, a motor shaft driven by said motor, and said motor shaft being mechanically coupled to said cam.

4. An oscillating fluid jetting apparatus according to claim 3, wherein said motor shaft is secured to said cam at a distance from an axial center of said cam.

5. An oscillating fluid jetting apparatus according to claim 1, wherein a nozzle is secured to an end portion of said conduit.

6. An oscillating fluid jetting apparatus comprising:

a conduit, a follower mounted with respect to said conduit;

a cam, said follower mechanically driven by said cam, drive means for moving said cam with respect to said follower:

a housing, securement means for securing a portion of said conduit with respect to said housing; and an outlet block having an outlet block throughbore, said outlet block secured with respect to said housing, an end cover having a cover opening, said end cover mounted with respect to said outlet block, an outlet end portion of said conduit extending through each of said outlet block throughbore and said cover opening.

7. An oscillating fluid jetting apparatus according to claim 6, wherein said outlet block and said end cover forms a chamber, and said cam and said follower are housed within said chamber.

8. An oscillating fluid jetting apparatus according to claim 6, wherein said opening has an opening diameter greater than an outer diameter of said conduit.

9. An oscillating fluid jetting apparatus comprising:

a conduit, a follower mounted with respect to said conduit;

a cam, said follower mechanically driven by said cam, drive means for moving said cam with respect to said follower, a housing, securement means for securing a portion of said conduit with respect to said housing, and said drive means positioned inside said housing.

10. An oscillating fluid jetting apparatus comprising a conduit, a follower mounted with respect to said conduit;

a cam, said follower mechanically driven by said cam, a motor, a motor shaft driven by said motor, said motor shaft being mechanically coupled to said cam, said motor shaft secured to said cam at a distance from an axial center of said cam, and said follower having two parallel sides, a guide member positioned on each side of said follower and said guide members parallel with respect to each other.

11. An oscillating fluid jetting apparatus according to claim 10, wherein said follower linearly oscillates with respect to said guide members upon following contact between an external surface of said follower and an external peripheral surface of said cam.

12. An oscillating fluid jetting apparatus comprising:

a conduit, a follower mounted with respect to said conduit:

a cam, said follower mechanically driven by said cam, a motor, a motor shaft driven by said motor, said motor shaft being mechanically coupled to said cam, said motor shaft secured with respect to said cam, said cam mechanically coupled to said follower, and said follower having a throughhole positioned at a distance from an axial center of said follower.

13. An oscillating fluid jetting apparatus according to claim 12, wherein said conduit extends through said throughhole.

14. An oscillating fluid jetting apparatus according to claim 13, further comprising three rollers mounted about a periphery of said follower.

15. An oscillating fluid jetting apparatus comprising:

a conduit, a follower mounted with respect to said conduit;

a cam, said follower mechanically driven by said cam, a motor, a motor shaft driven by said motor, said motor shaft being mechanically coupled to said cam, said outlet block having a shaft throughbore, and said motor shaft extending through said shaft throughbore.

16. An oscillating fluid jetting apparatus comprising:

a conduit, a follower mounted with respect to said conduit;

a cam, said follower mechanically driven by said cam, a motor, a motor shaft driven by said motor, said motor shaft being mechanically coupled to said cam, a motor conduit fixed with respect to said inlet block, and said motor conduit in fluid communication with a fluid inlet of said motor.

17. An oscillating fluid jetting apparatus comprising:

a conduit, a follower secured with respect to said conduit;

a cam, said follower mechanically driven by said cam, drive means for moving said cam with respect to said follower;

a housing, an inlet block mounted with respect to said housing, an end portion of said conduit fixed with respect to said inlet block;

an outlet block having a chamber and an outlet block throughbore, said outlet block mounted with respect to said housing;

said conduit extending through said outlet block throughbore;

and said cam and said follower positioned in said chamber.

* * * * *